US005102768A

United States Patent [19]

Light et al.

[11] Patent Number: 5,102,768

[45] Date of Patent: Apr. 7, 1992

[54] TRANSFER OF HIGH RESOLUTION TONED IMAGES TO ROUGH PAPERS

[75] Inventors: William A. Light, Victor; Donald S. Rimai, Webster; Louis J. Sorriero, Rochester, all of N.Y.

[73] Assignee: Eastman Kodak Company, Rochester, N.Y.

[21] Appl. No.: 491,769

[22] Filed: Mar. 12, 1990

[51] Int. Cl.[5] ..... G03G 13/14

[52] U.S. Cl. ..... 430/126

[58] Field of Search ..... 430/126

[56] References Cited

U.S. PATENT DOCUMENTS 4,430,412 2/1984 Miwa et al. .
4,439,462 3/1984 Tarumi et al. .
4,510,225 4/1985 Kuehnle et al. .
4,529,650 7/1985 Martinez .
4,686,163 8/1987 Ng et al. ..... 430/126
4,927,727 5/1990 Rimai et al. ..... 430/126
4,983,487 1/1991 Gilreath ..... 430/126

*Primary Examiner*—Marion E. McCamish
*Assistant Examiner*—Stephen Crossan
*Attorney, Agent, or Firm*—Dressler, Goldsmith, Shore, Sutker & Milnamow, Ltd.

[57] ABSTRACT

A process is provided for providing a non-electrostatically transferred toned image. From the surface of an element, the image is thermally transferred by contact to the face of a thermoplastic film that is strippably laminated to a paper or like backing. The film is then positioned against a receiver with the toner image therebetween, and the resulting composite is subjected to two successive stages of compressive heating. The process is particularly well suited for producing high resolution images from very small particle size toner powder on rough paper.

13 Claims, No Drawings

TRANSFER OF HIGH RESOLUTION TONED IMAGES TO ROUGH PAPERS

FIELD OF THE INVENTION

This invention is in the field of dry, non-electrostatic toner transfer procedures involving an intermediate and then a final transfer of a toner powder image which is preferably of high resolution from an element to a receiver before heat fusion.

BACKGROUND OF THE INVENTION

In electrostatic copying, an electrostatic latent image is formed on an element. That image can be developed into a visible image by the application of toner powder thereover. The resulting toned image is then transferred from the element to a receiver to which the transferred toned image is fixed usually by heat fusion. The transfer of the toned image to the receiver has usually been electrostatically accomplished using an electrostatic bias applied between the receiver and the element.

In order to produce copies of very high resolution, it is necessary to use toner particles that have a very small particle size, that is, less than about 8 microns.

Electrostatic transfer of very small toner particles, particularly of those having a particle diameter less than about 12 microns, is difficult to accomplish because, during such transfer, the forces holding the particles to the element are greater than the electrostatically generated transfer forces. To avoid this problem, a non-electrostatic transfer process must be used with toned images of such particles.

One suitable transfer process is provided by a thermally assisted transfer procedure. A receiver is heated prior to entering a transfer nip so that, in the nip, the surface temperature of the receiver is, typically in the range of about 60° to about 90° C. Upon entering the nip, the receiver is contacted against the toned image formed on the element. The heated receiver sinters the toner particles, causing them to stick to each other and to the receiver, thereby effecting a transfer of the toned image from the element to the receiver. The element and the receiver are separated, and then the transferred toned image is heat fused or otherwise fixed to the receiver. This process is useful, but suffers from the disadvantage that, the receiver must be smooth. Moreover, it is frequently necessary to use a low surface energy element or coat said element with a release aid to effect said transfer.

Another suitable process is provided by a modified thermally assisted transfer process. Here, a receiver is provided with a thermoplastic polymer coating which may have a layer of a release agent thereon. The coating polymer $T_g$ is not more than about 10° C. above the toner polymer $T_g$. A toned image is transferred using a procedure similar to that employed in the above described thermally assisted transfer process. Toner particles of the image adhere to or become partially embedded in the polymer coating. Subsequent to transfer the image is fixed. Scattering is avoided and substantially all toner powder is transferred. This process suffers from the disadvantage that specially prepared receivers must be used.

However, so far as now known, no thermally assisted transfer process is known by which a high resolution toner powder image comprised of very small toner particles can be transferred from an element to a rough paper, cloth or similar surface without significant loss of image degradation.

SUMMARY OF THE INVENTION

A process is provided for a two-step transfer of a toner powder image from an element to a receiver which can be a rough surfaced substrate such as cloth or paper. The process is particularly suitable for transfer of high resolution toner powder images comprised of very small toner particles from an element to a rough surfaced receiver with little or even no loss in image resolution.

The resulting toned imaged receiver can be heat fused. Characteristically, when the receiver is a rough paper substrate, a high quality image is produced which displays higher quality in image characteristics such as granularity, resolution and sharpness than has been known to have been achieved with small toner particles on such a rough surface.

In the present invention, a transferable toner powder image formed on the surface of an element by known electrostatic latent image formation and toner powder development procedures is intermediately transferred with thermal assist to the face of a transparent thermoplastic film that is strippably laminated to a paper or like backing. The thermoplastic film is then positioned against a receiver with the toner powder image positioned between the receiver surface and the image-bearing surface of the thermoplastic film. This composite is subjected to a first combination of heat and compressive pressure which accomplishes a transfer of toner particles in the image to adjacent contacting surface portions of the receiver and results in the lamination of the thermoplastic film to the receiver. This first combination of heat and pressure is generally sufficient to fix the image to the receiver. If it is insufficient, the resulting laminate is then subjected to a second combination of heat and compressive pressure which accomplishes heat fusion of the toner particles and consolidation of the laminate structure. The paper backing is stripped away either before the application of such second combination of heat and pressure or after such application. Accordingly, the present invention provides a two-step toned image transfer technique using thermal assistance for producing copies having high image resolution on a receiver.

In the resulting laminate, the image that is captured in the interfacial region between the film and the receiver appears to exist more in the thermoplastic film layer than in the receiver. When the image is comprised of heat fused very small toner particles, high resolution is observed that is comparable to the initially produced transferable image on the element surface. Accordingly, the present invention provides a new and improved class of imaged receivers.

A particularly preferred class of imaged receivers of this invention comprises laminates of a rough paper and a thermoplastic film wherein the heat fused image formed generally in the interfacial region therebetween is comprised of heat fused very small toner particles.

A principle feature of the present invention is the provision of technology which permits one to produce high quality toned, heat fused images on a variety of receiver surfaces especially including rough paper.

Another feature is the provision of technology which is adaptable for use with conventional copying equipment and conventional rough paper receivers. Thus, the structure of a thermoplastic film strippably laminated to a paper backing can be preliminarily prepared under controlled conditions in a factory or the like, so that an operator of such copying equipment can use such a laminated structure, copying equipment and auxiliary laminating equipment, to practice the present invention. Very little additional or new apparatus beyond such conventional equipment is needed.

Other and further aims, features, advantages, and the like will be apparent to those skilled in the art when taken with the appended claims.

DETAILED DESCRIPTION OF THE INVENTION

The term "particle size", or the term "size", or "sized" as employed herein in reference to the term "particles", means the mean volume weighted diameter as measured by conventional diameter measuring devices, such as a Coulter Multisizer, sold by Coulter, Inc. Mean volume weighted diameter is the sum of the mass of each particle times the diameter of a spherical particle of equal mass and density, divided by total particle mass.

The term "glass transition temperature" or "$T_g$" as used herein means the temperature at which an amorphous polymer changes from a glassy state to a liquid state. This temperature ($T_g$) can be measured by differential thermal analysis as disclosed in N. F. Mott and E. A. Davis, "Electronic Processes in Non-Crystalline Materials", Oxford Press (1971).

The term "melting temperature" or "$T_m$" as used herein means the temperature at which a crystalline polymer changes from a solid state to a liquid state. This temperature ($T_m$) can be measured by differential thermal analysis as disclosed in "Electronic Processes in Non-Crystalline Materials".

The term "surface tension" or "surface energy" as used herein means the energy needed to create a surface. It can be measured by measuring the contact angle of two liquids such as water and diiodomethane and adding the polar and dispersive contributions as disclosed in "Physical Chemistry of Surfaces", $4^{th}$ ed., Adamson (1982).

The term "element" as used herein refers to any of the known electrographic elements, including photoconductor elements, graphic elements, dielectric recording elements, and like electrographic elements. Examples of such elements can be found in, for instance, U.S. Pat. Nos. 4,175,960 and 3,615,414.

The term "receiver" as used herein refers to a substrate upon which a toner powder image can be formed by deposition and fixing by means such as subsequent heat fusion. Examples of suitable receivers include paper, cloth, plastic film, such as films of polyethylene terephthalate, polycarbonate, or the like, which are preferably transparent and therefore useful in making transparencies, sheet metal and the like. The receiver must not melt, soften, or lose mechanical integrity during transfer, sintering, or heat fusion of toner particles as taught herein. Preferred substrates do not readily absorb the thermoplastic polymer matrix of the toner particles when the particles are being heat fused, so that the polymer tends to stay on the surface portions of a substrate and to form a good bond thereto. In general, a flexible receiver is particularly desirable, and may be necessary when the present invention is to be practiced using certain conventional or specially modified electrophotographic copying machines. A receiver is necessary in the practice of this invention because the thermoplastic film employed in the practice of this invention may not be self supporting, or have sufficient structural integrity, to be used as an image support. Moreover, this invention permits one to produce high quality images on a variety of receivers selected by the customer.

The term "locations of contact" as used herein in relation to toner particles employed in the practice of this invention and to surfaces contacted thereby refers to localized regions on individual toner particle surfaces which are in contact either with one another, or with the surface upon which such a particle is deposited.

The term "sinters" or "sintering" as used herein in relation to toner particles employed in the practice of this invention refers to bonding or fusion that is thermally achieved at locations of contact existing either between adjacent toner particles or between toner particles and an adjacent surface. The term "sinter" and equivalent forms is distinguished for present purposes from a term such as "melts", "melting", "melt", "melt fusion" or "heat fusion". In heat fusion, in response to sufficient applied thermal energy, toner particles tend to lose their discrete individual identities to melt, and to blend together into a localized mass, as when a toner powder is heat fused and thereby bonded or fixed to a receiver.

Toner particles employed in the practice of this invention can be conventionally prepared. Broadly, suitable toners can have particle sizes in the range of about 1 to about 100 microns. In the practice of this invention where very small particle size toner powders are being used, the particles have a size in the range of about 2 to about 15 microns, and preferably in the range of about 3 to about 8 microns. Particularly when very small particle size toner powders are being used, it is desirable to have a narrow particle size distribution.

Toner particles used in the practice of this invention typically comprise a thermoplastic matrix polymer which has dispersed therein a charge control agent and a colorant (i.e., a dye or a pigment) in amounts such as are conventionally used in the art. Thus, the particles can comprise about 80 to about 92 weight percent of polymer, about 0.25 to about 1.0 weight percent of charge control agent, and about 8 to about 20 weight percent of colorant.

The thermoplastic polymer in toner particles used in the practice of this invention preferably has a glass transition temperature in the range of about 40° to about 80° C., although the polymers can have somewhat lower and higher $T_g$'s. Preferably, the thermoplastic polymer has a melting point ($T_m$) that is in the range of about 65° to about 200° C., although the polymers can have somewhat lower and higher $T_m$'s. Presently more preferred are thermoplastic polymers having a melting point ($T_m$) in the range of about 65° to 120° C.

Preferably, the particle size distribution for a given group of toner particles is narrow. For example, a size distribution or standard deviation in the range of about ±2 microns from a mean particle size is preferred, although the toner particles can have larger and smaller deviations, if desired. Suitable methods for making toner powders, and suitable toner powder compositions and additives can be made by compounding and grinding, emulsion polymerization, etc. Classification can be used to alter the average particle size and distribution.

Preferably, the toner particles have relatively high caking temperatures, such as caking temperatures above about 60° C., so that they can be stored with little or no agglomeration or caking.

Polymers for use in toner particles which have such properties can be chosen from polyesters such as poly(acrylic and methacrylic acid) derivatives, including poly(alkylacrylates), poly(alkylmethacrylates), and the like, wherein the alkyl moiety contains 1 to about 10 carbon atoms; styrene containing polymers, including blends thereof such as polystyrene and poly(styrene acrylics); and the like.

For example, the polymers can comprise a polymerized blend containing on a 100 weight percent basis, about 40 to about 100 weight percent of styrene, about 0 to about 45 weight percent of a lower alkyl acrylate or methacrylate having 1 to about 6 carbon atoms in the alkyl moiety, such as methyl, ethyl, isopropyl, butyl, etc., and about 5 to about 50 weight percent of a vinyl monomer other than styrene, such as, for example, a higher alkyl acrylate or methacrylate having about 6 to about 20 or even more carbon atoms in the alkyl moiety. Typical styrene-containing polymers prepared from such a copolymerized blend are copolymers prepared from a monomeric blend which comprises on a 100 weight percent basis about 40 to about 60 weight percent styrene or styrene homolog, about 20 to about 50 weight percent of a lower alkyl acrylate or methacrylate, and about 5 to about 30 weight percent of a higher alkyl acrylate or methacrylate, such as ethylhexyl acrylate (e.g., styrene-butylacrylate-ethylhexylacrylate copolymer, or the like). Preferred styrene copolymers are those which are covalently crosslinked with a small amount of a divinyl compound, such as divinylbenzene. A variety of other useful styrene-containing toner polymer materials are disclosed in U.S. Pat. Nos. 2,917,460; 2,788,288; 2,638,416; 2,618,552; and 2,659,670; and Re 25,316.

Those skilled in the art will appreciate that various additives, such as colorants, charge control agents, and the like, known to the art can be incorporated into the toner particles in conventional quantities.

Thermoplastic polymers suitable for employment in the transparent thermoplastic films utilized in the practice of this invention preferably have glass transition temperatures in the range of about 40° to about 80° C., more preferably about 45° to 60° C. If a lower $T_g$ for the polymer is used, the polymer may be too soft and cause blocking or sticking of the element but, if a higher $T_g$ for the polymer is used, then the polymer may be too stiff to pick up the toner particles at the temperatures employed. Compared to the glass transition temperature of the thermoplastic polymer used in the toner powder employed in a given situation, the film thermoplastic polymer should have a $T_g$ which is not more than about 10° C. above the $T_g$ of the toner thermoplastic polymer in order to facilitate toner powder transfer by pressing toner particles into the surface of the warmed thermoplastic film. Melting of the toner powder in the nip should be avoided. For example, melting can cause the toner powder to adhere to the element or damage the element. Melting and spreading of the toner can also result in an increase in grain and a loss of resolution. Since fixing of the toner by melt fusion on a receiver surface generally occurs at a higher temperature and requires longer fuser nip durations than employed in thermally assisted transfer, melting can be avoided during transfer.

Thermoplastic polymers used in the films preferably have melting temperatures ($T_m$) in the range of about 65° to about 200° C., more preferably in the range of about 65° to 120° C.

Thermoplastic polymers used in the films preferably have a surface energy in the range of about 40 to about 50 dynes per centimeter. If polymers having a lower surface energy are used, the film polymer may not adhere to the toner particles being removed from the element in the transfer, while if polymers having a higher surface energy are used, the film polymer may tend to stick to the element.

Thermoplastic polymers used in the films preferably have a number average molecular weight in the range of about 20,000 to about 500,000. For condensation polymers, the preferred number average molecular weight range is about 20,000 to about 80,000. For addition polymers, the preferred number average molecular weight is about 50,000 to about 500,000. Lower molecular weight polymers may have poor physical characteristics and may be brittle and tend to crack. Higher molecular weight polymers may have poor flow characteristics and may offer no significant benefits for the additional expense incurred.

Preferred film polymers are amorphous, but crystalline or partially crystalline polymers are also suitable. Other desirable characteristics for film polymers include thermal stability, abrasion resistance and resistance to air oxidation and discoloration.

Polymers for film use having such properties can be chosen from among polyesters; polystyrenes; styrene-acrylic copolymers; polymethyl methacrylate; polyvinyl acetate; and polyolefins, including olefin copolymers such as polyvinylethylene-co-acetate, polyethylene-co-acrylics, amorphous polypropylene, copolymers and graft copolymers of polypropylene; and the like. Mixtures of different polymers (polyblends) can be employed. The presently preferred thermoplastic material is a blend of polyesters. Examples of suitable polyesters include poly(2,2-oxydiethylene-co-2,2-dimethyl-1,3-propylene terephthalate) and poly(2,2-oxydiethylene-co-ethyleneterephthalate).

Thermoplastic polymers can be formed into films by conventional extrusion procedures.

The thermoplastic films utilized in the practice of this invention have thicknesses in the range of about 5 to about 40 microns, and preferably in the range of about 10 to about 20 microns. Thinner films may be insufficient to achieve substantially complete toner transfer from the element or may have insufficient structural integrity for use in strippable laminates with a paper backing, as explained herein. Thicker films appear to be unnecessary and may result in various disadvantages, such as warpage of an imaged receiver of this invention, delamination, embrittlement, lost in image sharpness, or the like.

Strippable laminates of film forming thermoplastic film and an economical but effective supporting substrate, such as cellulosic paper, can be prepared by any convenient or conventional procedure such as solvent coating, melt extrusion, latex coating, or the like. A presently preferred procedure for preparing such strippable laminates comprises coating the material from a solution in solvents such as dichloromethane or coextruding the thermoplastic with polyethylene onto a support. The bond strength should be sufficient so that the material does not spontaneously peel.

In the preferred practice of this invention, it is desirable to employ a release agent to minimize sticking between contacting surfaces involved in the transfer procedures.

For example, to enhance separation of the element from the thermoplastic film in the practice of this invention, a release agent may be employed. However, if a release agent is deposited upon one face of the thermoplastic film and that face is used first for deposition of a toned image from the element and then for laminating to a receiver in accordance with this invention, it is possible that the lamination bond strength between the receiver surface and the thermoplastic film will be reduced to a level considered undesirable or insufficient since the possibility of delaminating or stripping of the thermoplastic film from the receiver is not contemplated by this invention. Hence, a release agent is preferably coated on the face of the element rather than in the film.

Of course, a release agent can be deposited upon the other face of the thermoplastic film; that is, the face thereof which is strippably laminated to the paper backing. Alternatively, the release agent can be mixed with the polymer prior to coating. In these situations, the release agent can serve as an aid to enhancing strippability between paper and film.

The term "release agent" as used herein refers to a substance which, when present at the time when two surfaces are contacted together, either prevents bonding or sticking from occurring between such surfaces or, if bonding does occur, causes a bond of such a low strength to result that the two surfaces can be separated without leaving any substantial fragments of one surface embedded in the other thereof. Preferred release agents for use in the present invention have a low surface energy which is preferably less than about 40 dynes/centimeter. A suitable release agent for use in the practice of this invention should tend to stay on or near the surface to which it is applied. For example, if a release agent penetrates into a polymer layer in significant concentrations, the polymer integrity may be weakened, thereby adversely affecting the bondability of the polymer layer to another surface in the presence of heat or adversely affecting the adhesion of the toner.

A release agent should not be chemically reactive with a polymer employed in the practice of this invention since it has been found that chemically reactive release agents do not work well in the practice of this invention. Examples of suitable release agents for use in this invention include nonpolar compounds, such as hydrophobic metal salts of organic fatty acids, for instance, zinc stearate, nickel stearate, zinc palmitate, and the like; polysiloxanes, including siloxane copolymers, such as poly[4,4'-isopropylidenediphenylene-co-block-poly-(dimethylsiloxanediol) sebocate], and the like; fluorinated hydrocarbons; perfluorinated polyolefins; semi-crystalline polymers, such as certain polyethylenes, polypropylenes, and the like. Polysiloxane release agents are presently preferred.

The release agent can be applied by various techniques known to the art, such as solvent coating, or rubbing (when a release agent is being applied as a coating upon an element or the like), mechanical mixing (when the polymer is blended with a release agent prior to coating), or the like.

Formation of the release agent layer is preferably accomplished by mixing the release agent into a melt with the thermoplastic polymer and extruding the melt directly into the film. The melt can comprise about 1 to about 5% by weight of the release agent and about 95 to about 99% by weight of the thermoplastic polymer. As the melt solidifies, the release agent comes to the surfaces of the film because the energy of the surfaces thus formed is lower than it would be without the release agent coating the surface.

Coatings of a release agent in layered form having a thickness in the range of about 30 Å to about 1 micron appear to be useful for purposes of practicing the present invention, although thicker and thinner coatings can be used.

In the practice of the process of this invention, one first contacts one face of a transparent thermoplastic film against the surface of an element. The element surface has thereon a transferable image comprised of toner powder. The opposed face of the thermoplastic film is releasably bonded to a backing. Immediately prior to contacting, the film is heated to a temperature which sinters the toner particles at their locations of contact to each other and allows them to partially embed into the film. The image is transferred to the film.

Preferentially, the contacting is carried out using a combination of conditions that comprises:

a temperature such that in the nip the temperature of the film is sufficiently greater than its $T_g$ to partially embed the particles into the thermoplastic film;

a pressure in excess of 70 psi; and a time in the range of about 0.002 to about 0.2 seconds.

The image-carrying face of this thermoplastic film can then be contacted against the surface of a receiver, and the composite subjected to:

a temperature in the range of about 75° to 200° C.;

a pressure in excess of about 70 psi; and a time in excess of about 0.02 seconds.

Preferably, the backing is stripped or peeled from the film before application of the second combination, but it can be removed after the application of heat and pressure if the backing will not emboss the film during the application of the second combination.

The resulting copy comprises a receiver that is laminated to the thermoplastic film with an image comprised of heat fused toner powder therebetween.

Optionally, but preferably, a release agent is preliminarily coated on at least one of the element surfaces or the film face.

The invention is illustrated by the following examples:

EXAMPLE 1

A polystyrene layer, 10 μm thick, was coated from dichloromethane onto a polyethylene overcoated paper. A black and white image, consisting of both continuous tone and alpha-numeric regions was developed on an organic photoconductor and transferred using a thermally assisted transfer process. The toner particles were comprised of a styrene butylacrylate binder and carbon pigment and were approximately 4.5 μm in diameter. After transfer the strippable layer was removed from its support and attached to a piece of 20# xerographic bond paper by passing both the support and the paper, in contact so that the bond paper contacted the thermoplastic layer, through a set of fusing rollers. The paper contacted the heated roller (T=115° C.) while the supporting member contacted the unheated roller. The process speed was approximately 1 in/second. The strippable layer transferred totally to the bond paper and a high quality image, with high toner transfer efficiency, was obtained.

EXAMPLE 2

This Example is similar to Example 1 except that a graphic arts paper sold by the name "Kromekote" was used as the receiver. The results were similar to those obtained in Example 1.

EXAMPLE 3

This Example is similar to Example 2 except that, after stripping and attaching the strippable thermoplastic layer to the Kromekote receiver, the image was ferrotyped by casting it against Kapton-H, using the forementioned fusing rollers. A uniformly glossed image was obtained. No differential gloss, due to varying amounts of toner, was observed. This contrasts with similar finishing of images produced without a thermoplastic layer, where the gloss level varies with the amount of toner.

EXAMPLE 4

This Example is similar to Example 1 except that 4 mil thick Estar is used as the receiver. The image was subsequently ferrotyped, as described in Example 3. A high quality transparency was formed.

EXAMPLE 5

A color image was made by developing cyan, magenta, and yellow separations on an organic photoconductor. These were transferred in register to a strippable thermoplastic. The thermoplastic was comprised of a polyester marketed under the name "Kodabond 5116". This had been coated onto a supporting member by the process of melt extrusion. Transfer was accomplished using thermally assisted transfer. The toners were made principally of a styrene butylacrylate polymer containing appropriate pigments. After transferring all three colors, in register, to the thermoplastic, the thermoplastic was removed from its supporting member and attached to Kromekote paper, using the method described previously, but with the heated roller heated to 130° C. and the process speed at ¼ in/second. A high quality image with a matte finish was obtained. Subsequently, half of the image was ferrotyped against Kapton-H. This resulted in that part of the image having a high gloss finish.

The invention has been described in detail with particular reference to preferred embodiments thereof, but it will be understood that variations and modifications can be effected within the spirit and scope of the invention.

We claim:

1. A process of producing a non-electrostatically transferred toned image comprised of toner particles comprising the steps of:

(a) contacting one face of a transparent thermoplastic film against the surface of an element having thereon a transferable image comprised of toner powder on one surface thereof, the opposed face of said thermoplastic film being releasably bonded to a sheet to transfer the image to said film;

(b) removing the transferred image and the film from said element;

(c) heating said film to a temperature which sinters said toner particles at their locations of contact to each other and to said film; and (d) contacting the transferred image against the surface of a receiver to permanently fix the toner and film to said receiver and concurrently subjecting the composite to a first combination of conditions which comprises:

a temperature sufficiently in excess of $T_g$ of the thermoplastic film to allow particles to partially embed into the thermoplastic film;

a pressure in excess of about 70 psi; and a time in the range of about 0.002 to about 0.2 seconds.

2. The process of claim 1 that further comprises subjecting the product of step (c) to a second combination of conditions which comprises:

a temperature in the range of about 75 to about 200° C.;

a pressure in excess of about 70 psi; and a time in excess of about 0.02 seconds.

3. The process of claim 1 wherein said toner powder is comprised of a thermoplastic polymer having:

a glass transition temperature in the range of about 40° to about 80° C.; and a melting temperature in the range of about 65° to 200° C.

4. The process of claim 3 wherein said toner powder has a particle size n the range of about 4 to about 15 microns.

5. The process of claim 1 wherein said film has a thickness in the range of about 5 to 40 microns.

6. The process of claim 1 wherein said film is releasably laminated to a backing sheet.

7. The process of claim 6 wherein said backing sheet is a cellulosic paper.

8. The process of claim 1 wherein said receiver is paper.

9. The process of claim 1 wherein said receiver is cloth.

10. The process of claim 1 wherein said receiver is a polymer.

11. The process of claim 10 wherein said polymer is transparent.

12. The process of claim 1 wherein a release agent is preliminarily coated on at least one of said element surface or said one face of said thermoplastic film.

13. An imaged receiver prepared by the process of claim 1.

* * * * *